US011408328B2

(12) United States Patent
Tayama

(10) Patent No.: US 11,408,328 B2
(45) Date of Patent: Aug. 9, 2022

(54) ENGINE COOLING APPARATUS

(71) Applicant: SUZUKI MOTOR CORPORATION, Hamamatsu (JP)

(72) Inventor: Takahiko Tayama, Hamamatsu (JP)

(73) Assignee: SUZUKI MOTOR CORPORATION, Hamamatsu (JP)

( * ) Notice: Subject to any disclaimer, the term of this patent is extended or adjusted under 35 U.S.C. 154(b) by 0 days.

(21) Appl. No.: 17/108,825

(22) Filed: Dec. 1, 2020

(65) Prior Publication Data

US 2021/0164383 A1 Jun. 3, 2021

(30) Foreign Application Priority Data

Dec. 3, 2019 (JP) ..... JP2019-218854

(51) Int. Cl.

| | |
|---|---|
| ***F01P 5/10*** | (2006.01) |
| ***F01P 5/12*** | (2006.01) |
| ***F04D 13/02*** | (2006.01) |
| ***F01P 7/16*** | (2006.01) |
| ***F01P 11/04*** | (2006.01) |
| ***F01P 3/20*** | (2006.01) |
| ***F01P 3/18*** | (2006.01) |
| *F01P 7/14* | (2006.01) |

(52) U.S. Cl.

CPC ..... *F01P 7/16* (2013.01); *F01P 3/18* (2013.01); *F01P 3/20* (2013.01); *F01P 5/10* (2013.01); *F01P 11/04* (2013.01); *F01P 2007/146* (2013.01); *F01P 2060/04* (2013.01)

(58) Field of Classification Search

CPC ..... F01P 5/10; F01P 5/12; F01P 5/04; F02F 1/10; F04D 13/02

See application file for complete search history.

(56) References Cited

U.S. PATENT DOCUMENTS

| | | | | |
|---|---|---|---|---|
| 6,508,211 | B1 * | 1/2003 | Asano | F01P 7/16 123/41.1 |
| 2004/0123816 | A1 * | 7/2004 | Batzill | F01P 7/16 123/41.1 |
| 2007/0144461 | A1 * | 6/2007 | Ashida | F02F 1/40 123/41.1 |
| 2014/0345548 | A1 * | 11/2014 | Miura | F01P 11/08 123/41.08 |
| 2015/0010392 | A1 * | 1/2015 | Lazich | F04D 29/426 415/214.1 |
| 2018/0223721 | A1 * | 8/2018 | Matsushita | F01P 7/162 |

FOREIGN PATENT DOCUMENTS

JP 3819681 B2 9/2006

* cited by examiner

*Primary Examiner* — Long T Tran

(74) *Attorney, Agent, or Firm* — Stein IP, LLC

(57) ABSTRACT

An engine cooling apparatus configured to circulate cooling water between an engine and a radiator is provided. A cylinder is provided on an upper part of a crankcase in the engine and the radiator is configured to radiate heat of the cooling water that has passed through the engine. The engine cooling apparatus includes a water pump configured to eject cooling water toward the engine, and a thermostat configured to send cooling water to the radiator in response to a cooling water temperature. The water pump is attached to the crankcase from an outside in a vehicle width direction. The thermostat is attached to the water pump from an inside in the vehicle width direction. The thermostat overlaps the crankcase in a front view of the engine.

6 Claims, 9 Drawing Sheets

ENGINE COOLING APPARATUS

CROSS-REFERENCE TO RELATED APPLICATIONS

The disclosure of Japanese Patent Application No. 2019-218854 filed on Dec. 3, 2019, including specification, drawings and claims is incorporated herein by reference in its entirety.

BACKGROUND

The present invention relates to an engine cooling apparatus.

In general, in an engine, a circulation flow channel is formed in which cooling water from a water pump returns to the water pump via a water jacket and a radiator in a cylinder. A bypass flow channel that bypasses the radiator is connected to the circulation flow channel, and the cooling water is guided to the bypass flow path by closing a valve of a thermostat. When the engine is started, the valve of the thermostat is closed, and the cooling water passes through the bypass flow channel and bypasses the radiator, so that a warm-up of the engine is accelerated. As this type of engine cooling apparatus, a cooling apparatus has been proposed in which a thermostat is attached to a pump cover of a water pump (for example, see Patent Literature 1).

Patent Literature 1: Japanese Patent No. 3819681

SUMMARY

According to an aspect of the invention, there is provided an engine cooling apparatus configured to circulate cooling water between an engine and a radiator, wherein a cylinder is provided on an upper part of a crankcase in the engine and the radiator is configured to radiate heat of the cooling water that has passed through the engine, the engine cooling apparatus comprising:

a water pump configured to eject cooling water toward the engine; and a thermostat configured to send cooling water to the radiator in response to a cooling water temperature, wherein the water pump is attached to the crankcase from an outside in a vehicle width direction, the thermostat is attached to the water pump from an inside in the vehicle width direction, and the thermostat overlaps the crankcase in a front view of the engine.

DETAILED DESCRIPTION OF EXEMPLIFIED EMBODIMENTS

The thermostat is attached to the water pump described in Patent Literature 1 from an outside of a vehicle. Since the water pump is attached to an outer surface of a crankcase in some types of engines, a width dimension of the engine in a vehicle width direction is increased by attaching the thermostat to an outer surface of the water pump. Since a large number of pipes are connected to the water pump and the thermostat, there are problems that an external appearance of the engine deteriorates and an assembling property of the pipes deteriorates.

The present invention has been made in view of the above-described circumstances. An object of the present invention is to provide an engine cooling apparatus capable of reducing a size of an engine and improving an external appearance of the engine and an assembling property of a pipe.

Figure 1:
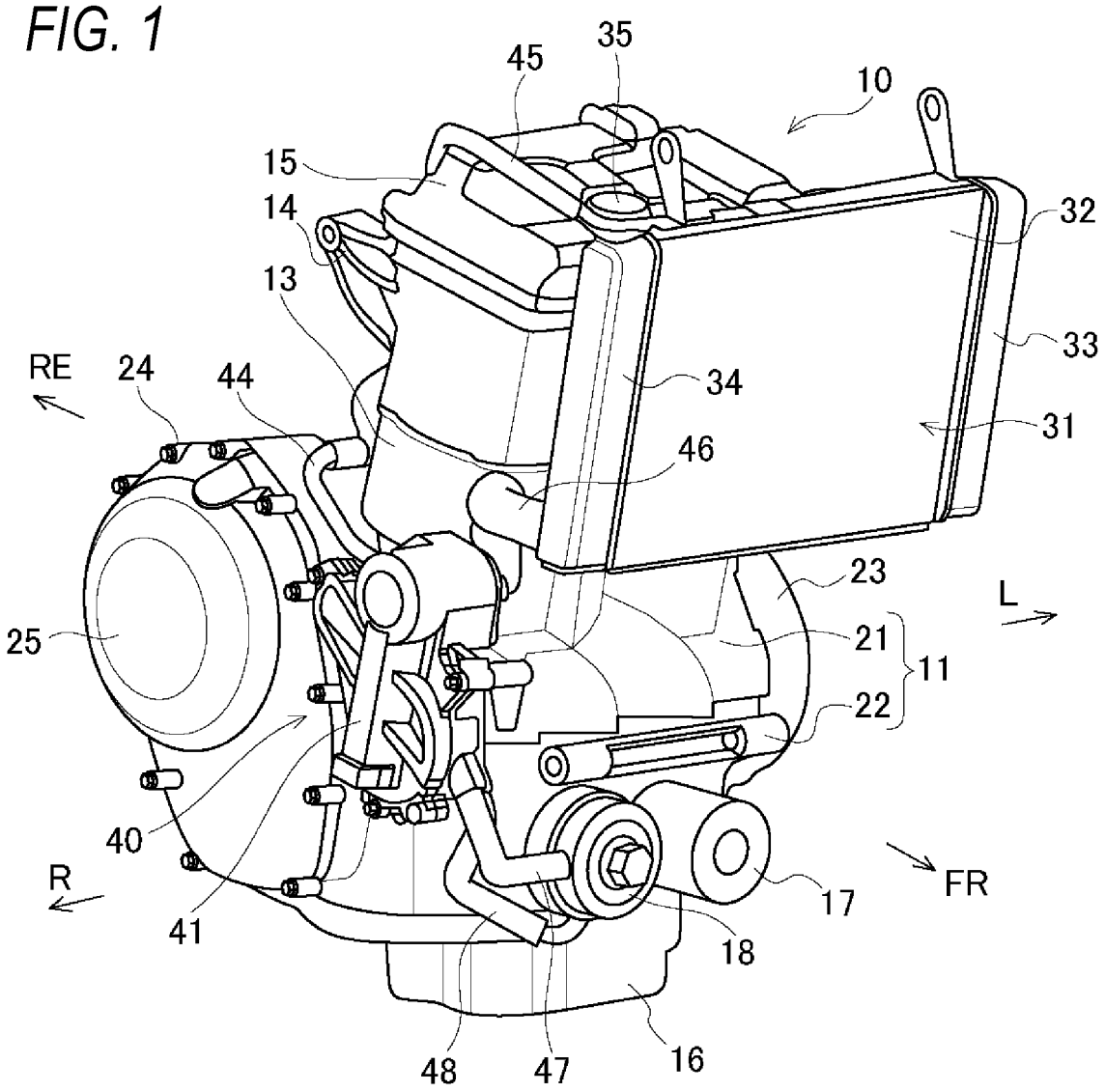
FIG. 1 is a perspective view of an engine as viewed from a right front thereof.
Figure 2:
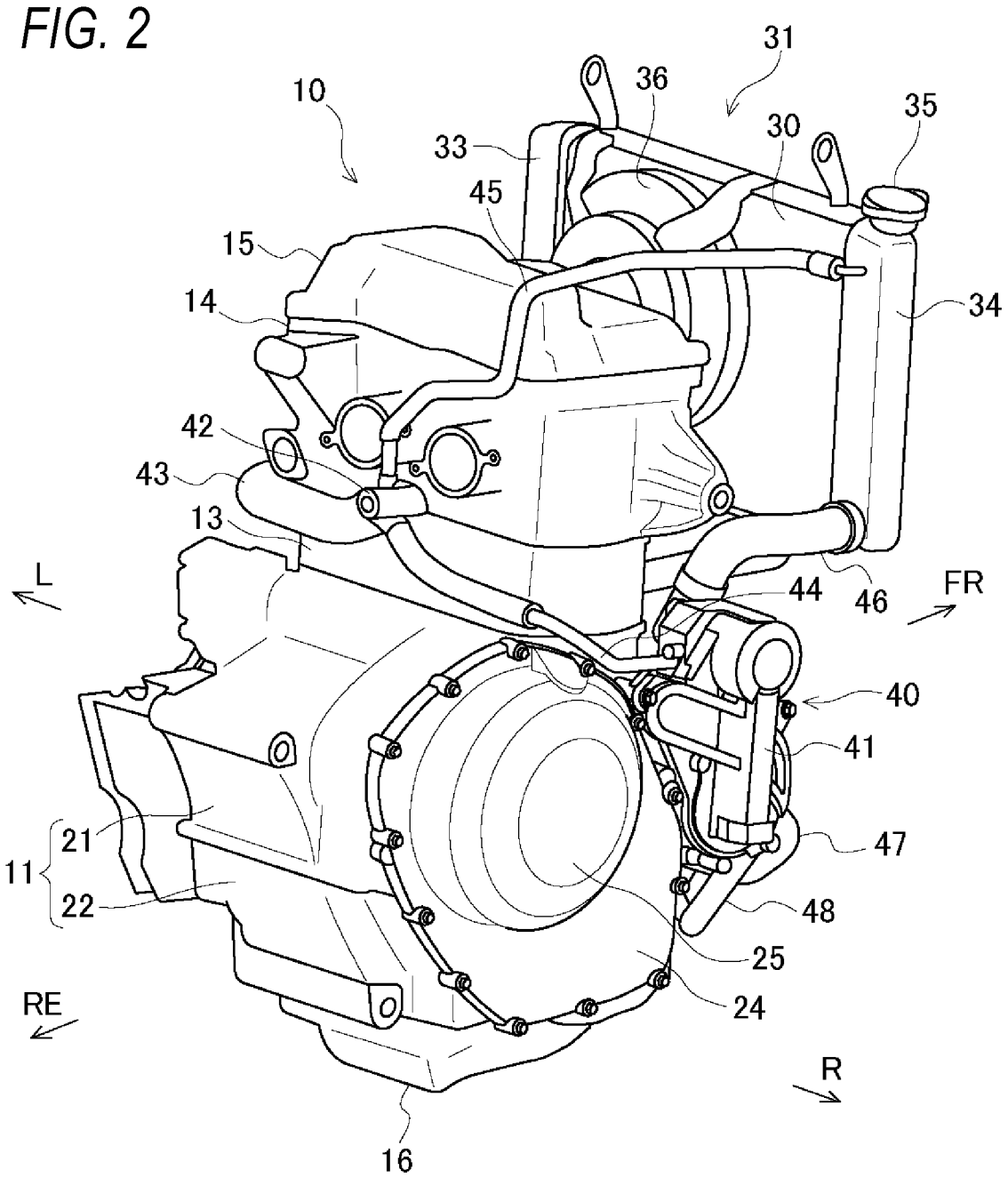
FIG. 2 is a perspective view of the engine as viewed from a right rear thereof.

An engine cooling apparatus according to an aspect of the present invention circulates cooling water between an engine and a radiator. A cylinder is provided on an upper part of a crankcase in the engine, and the radiator is configured to radiate heat of the cooling water that has passed through the engine. A water pump ejects the cooling water toward the engine, and a thermostat sends the cooling water to the radiator in response to a cooling water temperature. The water pump is attached to the crankcase from an outside in a vehicle width direction, and the thermostat is attached to the water pump from an inside in the vehicle width direction. Therefore, a pipe connected to the thermostat is inconspicuous, and an external appearance of the engine is improved. Further, the pipe for the water pump is not complicated, and an assembling property of the pipe is improved. Since the thermostat overlaps the crankcase as viewed from a front of the engine, the thermostat does not largely protrude from the crankcase to the outside in the vehicle width direction, an increase in a width dimension of the engine in the vehicle width direction is prevented, and a size of the engine is reduced. Hereinafter, an embodiment will be described in detail with reference to the accompanying drawings. In the following drawings, an arrow FR indicates a vehicle front side, an arrow RE indicates a vehicle rear side, an arrow L indicates a vehicle left side, and an arrow R indicates a vehicle right side. FIG. 1 is a perspective view of an engine as viewed from a right front thereof. FIG. 2 is a perspective view of the engine as viewed from a right rear thereof.

As shown in FIGS. 1 and 2, an engine 10 is a parallel two-cylinder engine in which a cylinder block 13 is provided on an upper part of a crankcase 11. A cylinder head 14 is attached to an upper part of the cylinder block 13, and a head cover 15 is attached to an upper part of the cylinder head 14. An oil pan 16 configured to store oil for lubrication and cooling is attached to a lower part of the crankcase 11. An oil filter 17 configured to remove foreign matters from oil and an oil cooler 18 configured to cool oil are attached to a front part of the crankcase 11.

The crankcase 11 includes an upper case 21 and a lower case 22 so as to be separable in an upper-lower direction. A magneto cover 23 is attached to a left side surface of the crankcase 11 so as to cover a magneto chamber in the case, and a clutch cover 24 is attached to a right side surface of the crankcase 11 so as to cover a clutch chamber in the case. A magnetic device (not shown) connected to a crankshaft is housed in the magneto chamber, and a clutch device (not shown) configured to transmit and cut off power from the crankshaft is housed in the clutch chamber. A cooling flow channel through which cooling water passes is formed in the crankcase 11, the cylinder block 13, and the cylinder head 14.

A radiator 31 configured to radiate heat of cooling water is provided in front of the cylinder block 13. The radiator 31 includes a radiator core 32 configured to exchange heat with a large number of tubes or heat radiation fins, an inflow tank 33 configured to allow cooling water to inflow from a left side of the radiator core 32, and an outflow tank 34 configured to allow the cooling water to flow out from a right side of the radiator core 32. A cooling water injection port is formed on an upper surface of the outflow tank 34, and a radiator cap 35 is attached to the injection port. On a back side of the radiator core 32, a radiator fan 36 configured to guide outside air toward the radiator core 32 on a stop of a vehicle or the like is provided.

The engine 10 is provided with a cooling apparatus 40 configured to circulate cooling water between the engine 10 and the radiator 31. A water pump 41 configured to eject cooling water toward the engine 10 is attached to the right side surface of the crankcase 11 as the cooling apparatus 40 of the engine 10. The water pump 41 is on a front side of the crankcase 11 with respect to the clutch cover 24 in a front-rear direction, and between the radiator 31 and the oil cooler 18 in an upper-lower direction. The water pump 41 is driven by an impeller 53 (see FIG. 5) having a balancer shaft (not shown) in the crankcase 11 as a rotation shaft. The water pump 41 will be described in detail later.

An ejection port 56 (see FIG. 5) of the water pump 41 communicates with the cooling flow channel in the crankcase 11, and the cooling flow channel in the crankcase 11 communicates with water jackets of the cylinder block 13 and the cylinder head 14. A connector 42 for a pipe joint protrudes from a rear part of the cylinder block 13, and is connected to an inlet pipe 43 and a bypass pipe 44. The cooling water is sent to the inflow tank 33 of the radiator 31 through the inlet pipe 43. The bypass pipe 44 bypasses the radiator 31, and the cooling water is returned to the water pump 41 through the bypass pipe 44. An air vent pipe 45 configured to remove air from the cooling water is connected to an upper surface of the connector 42. An outlet pipe 46 is configured to return the cooling water that has passed through the radiator core 32 to the water pump 41, and is connected to the outflow tank 34 of the radiator 31.

An inlet control type thermostat 85 (see FIG. 4) configured to control a flow of the cooling water from the outlet pipe 46 in response to a cooling water temperature is attached to the water pump 41. When the cooling water temperature is lower than a predetermined temperature, the thermostat 85 is closed, and the flow of the cooling water from the engine 10 toward the radiator 31 is blocked at an outlet of the outlet pipe 46 downstream of the radiator 31. The cooling water is returned from the engine 10 to the water pump 41 through the bypass pipe 44. When the cooling water temperature rises to the predetermined temperature or higher, the thermostat 85 opens, and the cooling water flows from the engine 10 to the radiator 31, so that the engine 10 is effectively cooled by the cooling water whose heat has been radiated by the radiator 31.

As described above, the cooling apparatus 40 of the engine 10 is provided with the thermostat 85 configured to send cooling water to the radiator 31 in response to a cooling water temperature. The thermostat 85 controls a flow of cooling water toward the radiator 31 and a flow of cooling water that bypasses the radiator 31. An inlet pipe 47, through which cooling water is supplied to the oil cooler 18, is connected to the water pump 41, and an outlet pipe 48, through which cooling water is returned to the water pump 41, is connected to the oil cooler 18. Cooling water is sent to the oil cooler 18 by driving of the water pump 41, and oil in the oil cooler 18 is cooled by the cooling water.

As described above, the water pump 41 is attached to a right side surface of the crankcase 11, and is positioned inside an outer surface 25 of the clutch cover 24 in the vehicle width direction. In this type of engine 10, when the thermostat 85 is attached to the water pump 41 from the outside in the vehicle width direction, the water pump 41 protrudes rightward from the outer surface 25 of the clutch cover 24, and a width dimension of the engine 10 in the vehicle width direction increases. When the thermostat 85 is attached to the water pump 41, it is required to consider an external appearance of the engine 10 and an assembling property of a pipe.

Therefore, in the cooling apparatus 40 according to the present embodiment, the thermostat 85 is attached to the water pump 41 from the inside in the vehicle width direction in consideration of the width dimension of the engine 10 in the vehicle width direction, the external appearance of the engine 10, and the assembling property of the pipe. The thermostat 85 is superposed on the crankcase 11 in a front view of the engine 10. Accordingly, even if the water pump 41 is attached to the crankcase 11 from the outside in the vehicle width direction, the thermostat 85 does not largely protrude rightward from the outer surface 25 of the clutch cover 24. The thermostat 85 does not deteriorate the external appearance of the engine 10 and the assembling property of the pipe.

Figure 3:
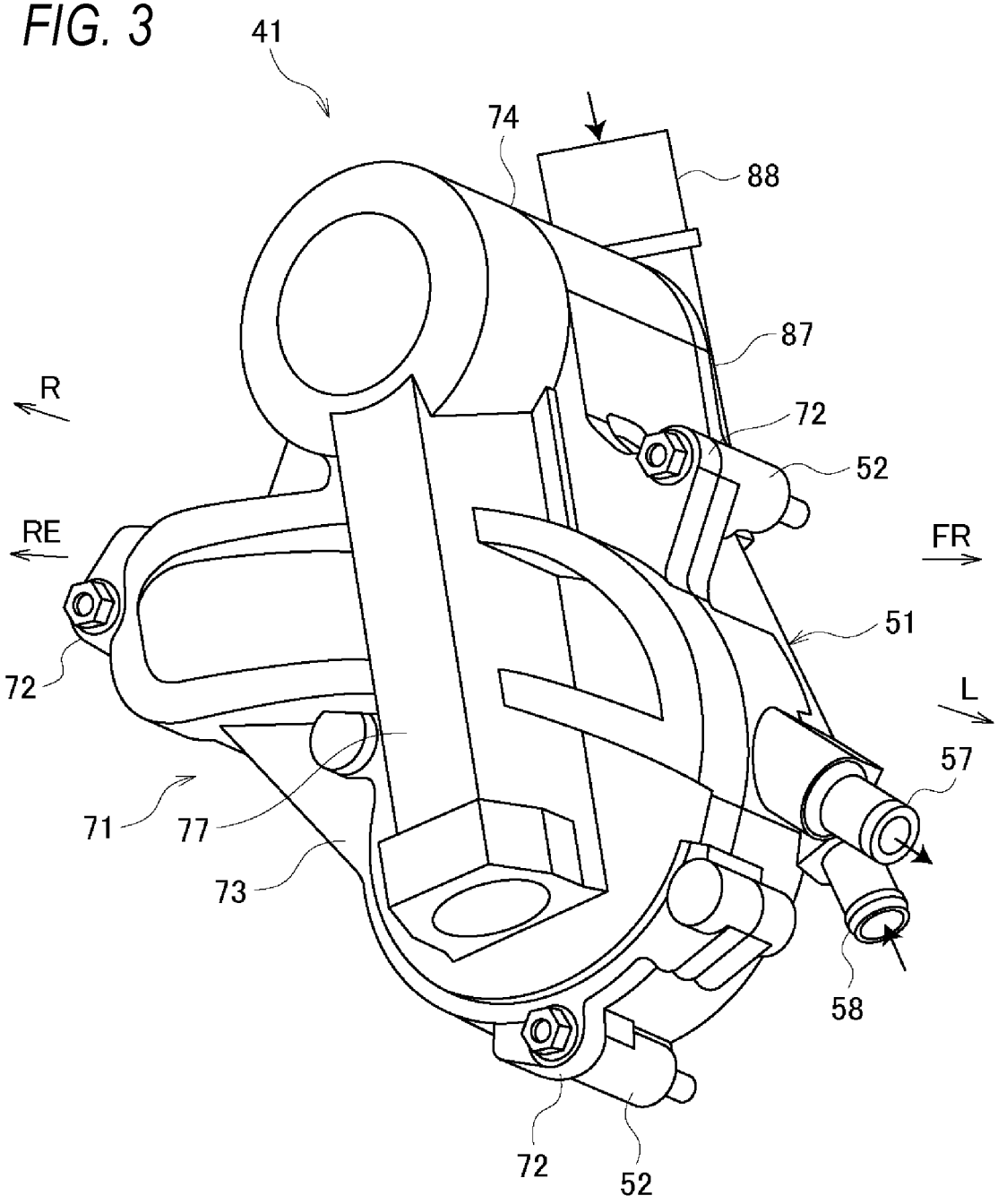
FIG. 3 is a perspective view of a water pump as viewed from a right side thereof.
Figure 4:
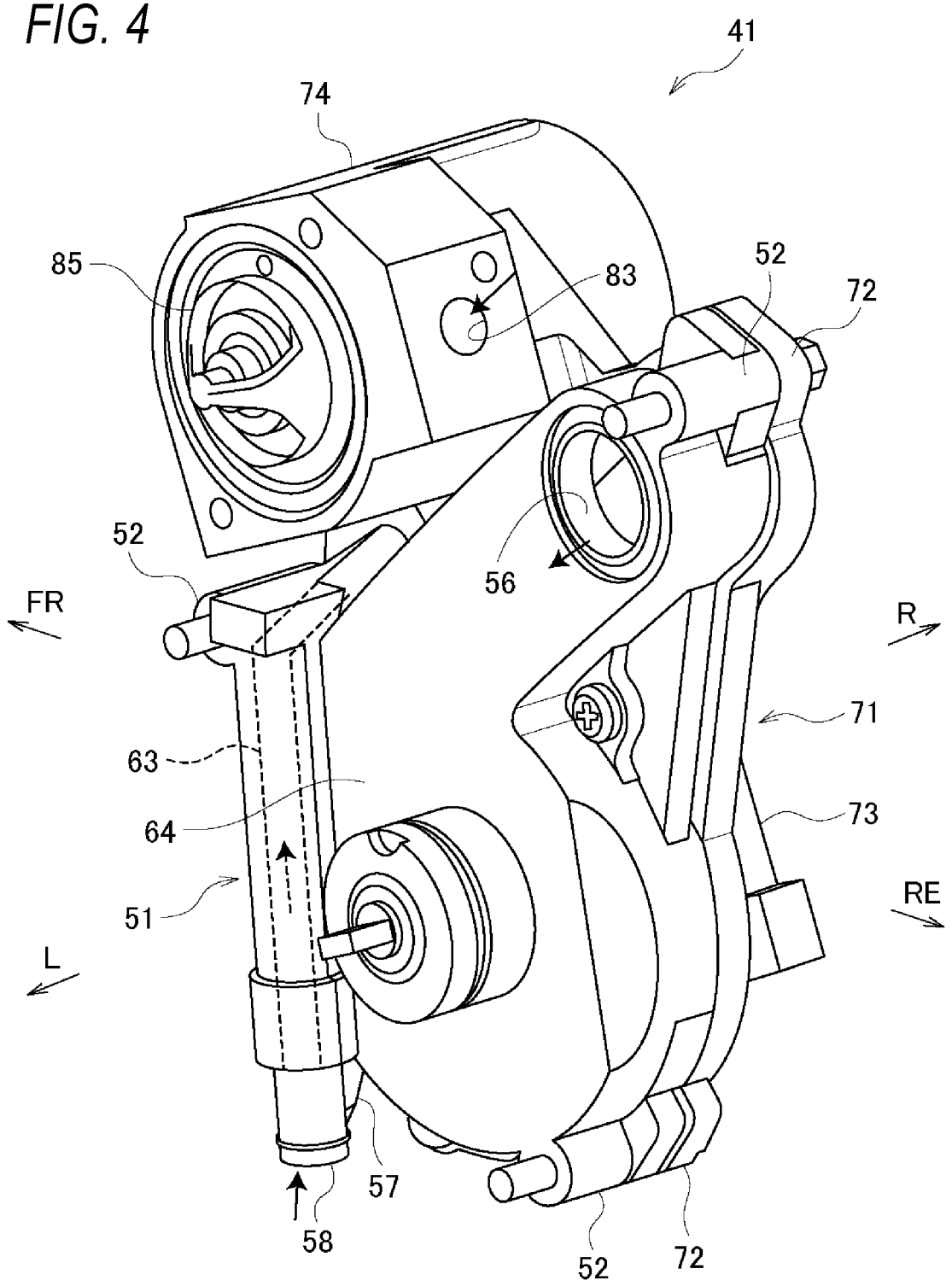
FIG. 4 is a perspective view of the water pump as viewed from a left side thereof.
Figure 5:
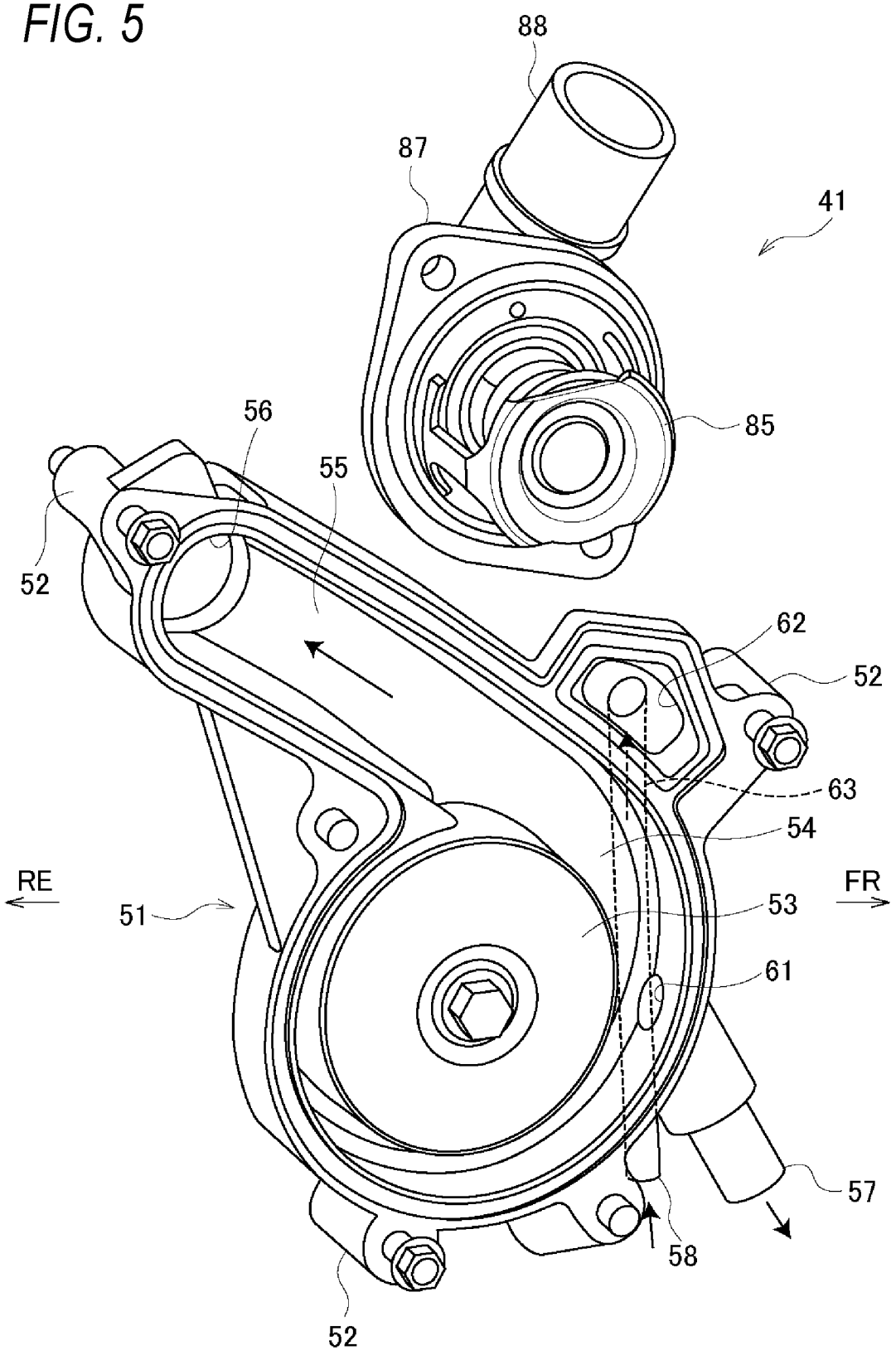
FIG. 5 is a perspective view of a water pump case and a thermostat.
Figure 6:
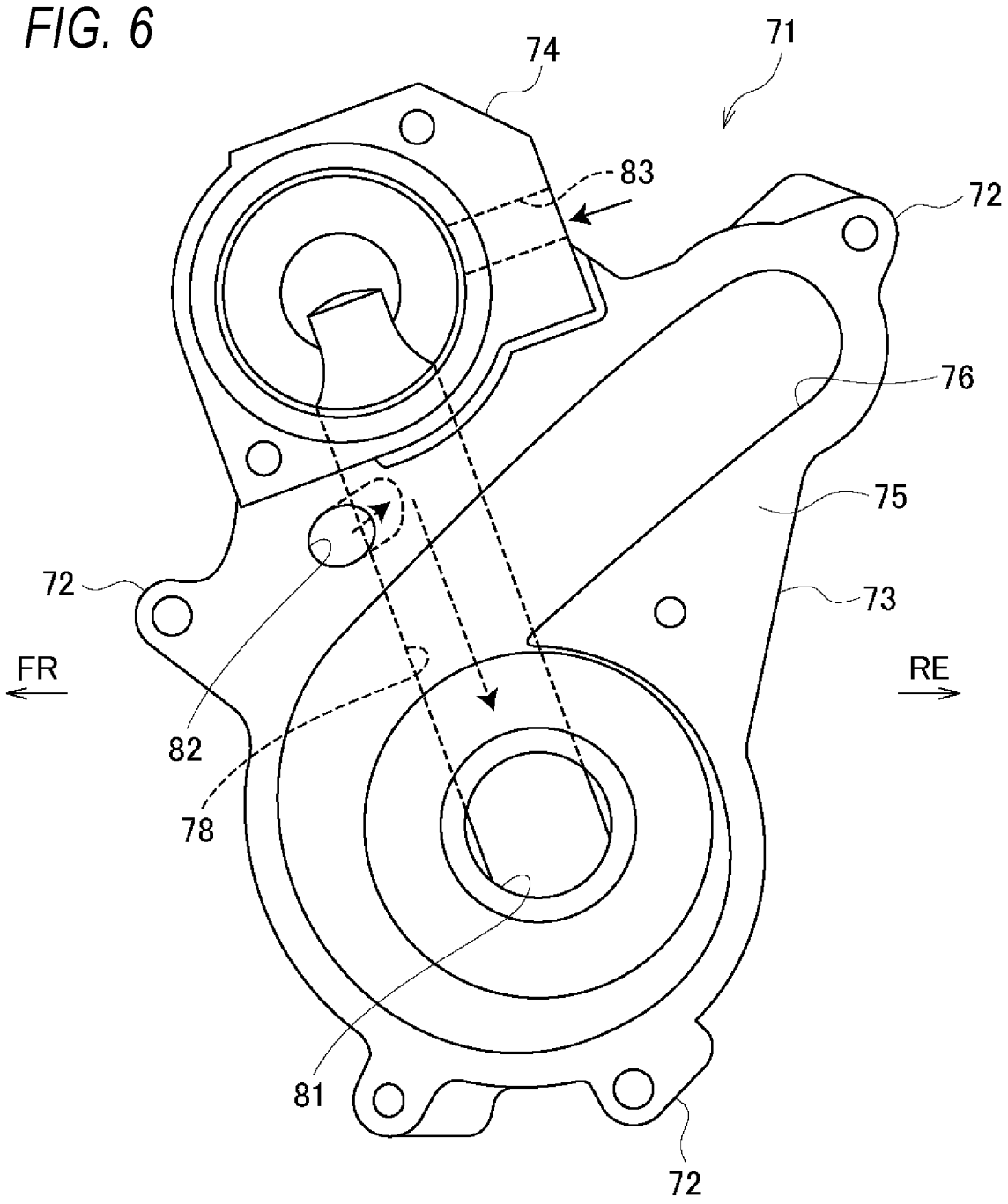
FIG. 6 is a side view of a water pump cover as viewed from an inside in a vehicle width direction.
Figure 7:
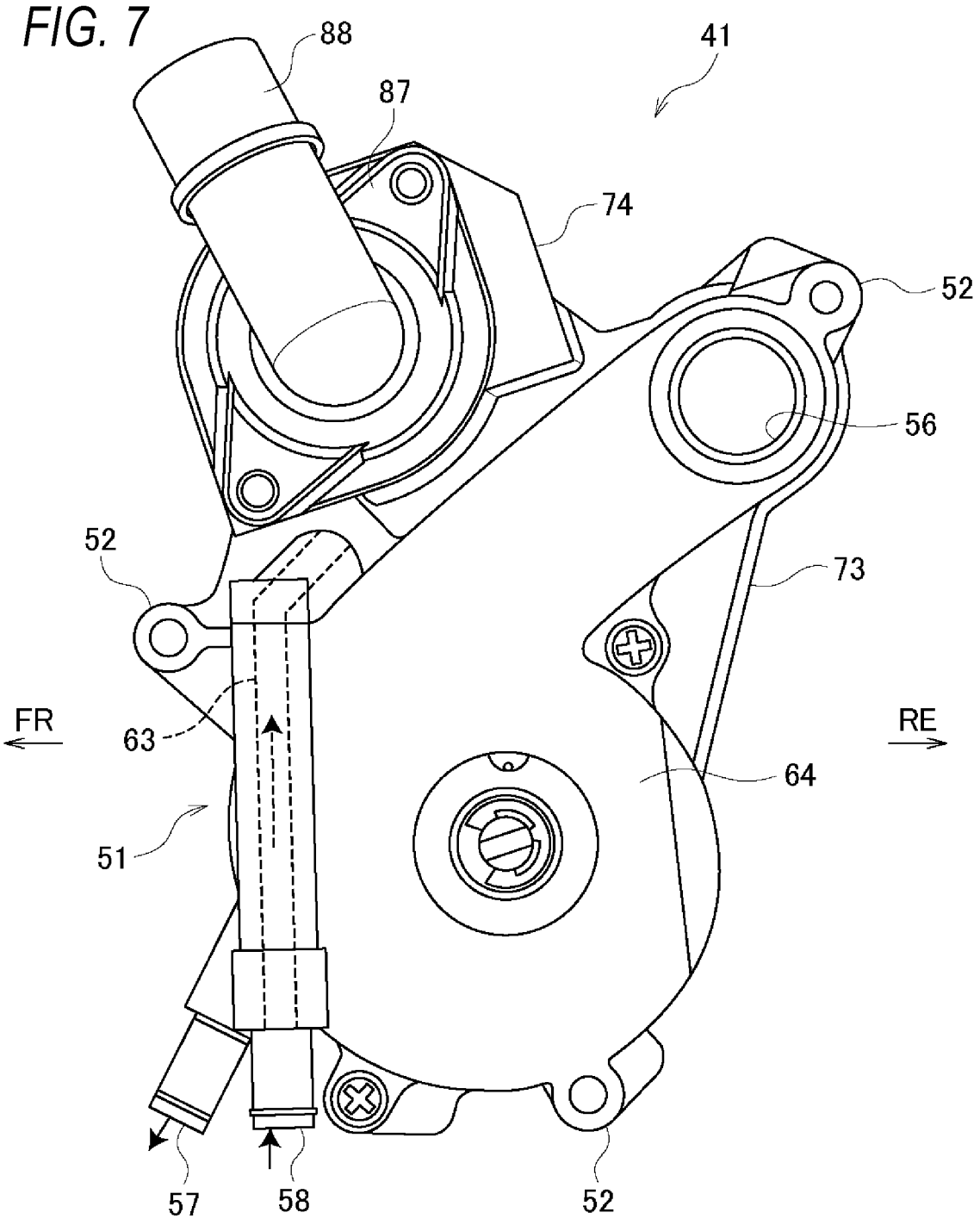
FIG. 7 is a side view of the water pump as viewed from the inside in the vehicle width direction.

Hereinafter, an engine cooling apparatus will be described with reference to FIGS. 3 to 7. FIG. 3 is a perspective view of a water pump as viewed from a right side thereof. FIG. 4 is a perspective view of the water pump as viewed from a left side thereof. FIG. 5 is a perspective view of a water pump case and a thermostat. FIG. 6 is a side view of a water pump cover as viewed from the inside in the vehicle width direction. FIG. 7 is a side view of the water pump as viewed from the inside in the vehicle width direction. FIG. 4 shows a state in which a thermostat cover is removed from the water pump.

As shown in FIGS. 3 to 5, the water pump 41 includes a water pump case 51 in which one surface thereof is opened, and a water pump cover 71 that covers an opening of the water pump case 51. Three boss portions 52, 72 are formed at outer edges of the water pump case 51 and the water pump cover 71. The water pump 41 is screwed via the boss portions 52, 72 so that a side of the water pump cover 71 is in contact with the crankcase 11. Inside the water pump case 51 and the water pump cover 71, a circular pump chamber 54 in which the impeller 53 is housed and an ejection flow channel 55 extending tangentially from the pump chamber 54 are formed.

The impeller 53 is a centrifugal impeller configured to pump cooling water using centrifugal force, and the cooling water is sent out to the ejection flow channel 55 by rotation of the impeller 53. The water pump case 51 is formed with an ejection port 56 through which cooling water is fed into the crankcase 11 from a front end side of the ejection flow channel 55. A pair of pipes 57, 58 for pipe joints are protruded from a lower front side of the water pump case 51. The inlet pipe 47 extending from the water pump 41 to the oil cooler 18 (see FIG. 1) is connected to one pipe 57, and the outlet pipe 48 returning from the oil cooler 18 to the water pump 41 is connected to the other pipe 58.

The water pump case 51 is formed with an outflow port 61 through which a part of cooling water flows from the pump chamber 54 into the one pipe 57. The water pump case 51 is formed with a communication flow channel 63 extending from the other pipe 58 toward an outflow port 62 above the pump chamber 54. The communication flow channel 63 is formed by bulging a side of an installation surface 64 of the water pump case 51 into a tubular shape. An upper part of the water pump case 51 is formed along the ejection flow channel 55 that is inclined so as to rise rearward from the pump chamber 54. Therefore, an empty space is secured for the thermostat 85 in front of the upper part of the water pump case 51.

As shown in FIGS. 6 and 7, the water pump cover 71 includes a cover body 73 having substantially the same shape as the water pump cover 71 in a side view, and a thermostat case 74 protruding upward from the cover body 73. The inner surface 75 of the cover body 73 is formed with shallow groove 76 in which the pump chamber 54 (see FIG. 5) and the ejection flow channel 55 are formed. An outer surface 77 (see FIG. 3) of the cover body 73 bulges outward in the vehicle width direction in a rectangular shape, and a suction flow channel 78, through which cooling water is suctioned from the thermostat case 74 into the pump chamber 54, is formed inside this bulging part. An outflow port 81 of the suction flow channel 78 is opened on the rotation shaft of the impeller 53 (see FIG. 5).

The inner surface 75 of the cover body 73 is formed with an inflow port 82 opened toward the suction flow channel 78 at a position corresponding to the outflow port 62 (see FIG. 5) of the water pump case 51. Therefore, cooling water from the oil cooler 18 is returned to the pump chamber 54 via the suction flow channel 78. An upper part of the cover body 73 is formed along the ejection flow channel 55 in the same manner as the water pump case 51, and the thermostat case 74 is formed in front of the upper part of the cover body 73. Since the front of the upper part of the water pump case 51 is an empty space, the thermostat case 74 can be bulged inward in the vehicle width direction from the inner surface 75 of the cover body 73.

As described above, a part of the water pump cover 71 protrudes in a direction perpendicular to the vehicle width direction with respect to the water pump case 51 to form the thermostat case 74 that houses the thermostat 85 (see FIG. 5). The thermostat case 74 is formed in a substantially cylindrical shape with a bottom, and one inner surface of the thermostat case 74 in the vehicle width direction is opened in a circular shape. The thermostat 85 is attached to an opening edge of the thermostat case 74, and an inner side of the thermostat case 74 is a housing chamber of the thermostat 85. A rear wall of the thermostat case 74 is formed with a through passage 83 to which the bypass pipe 44 (see FIG. 2) is connected.

A thermostat cover 87 that covers the housing chamber of the thermostat 85 is attached to the thermostat case 74. A pipe 88 for pipe joint is formed at the thermostat cover 87. The outlet pipe 46 that returns from the radiator 31 (see FIG. 1) to the water pump 41 is connected to the pipe 88. The thermostat 85 is attached in a direction of stopping cooling water from the outlet pipe 46. A flow rate of cooling water flowing from the outlet pipe 46 toward the thermostat case 74 is adjusted in response to an opening degree of the thermostat 85 of the thermostat case 74.

Wax is sealed inside the thermostat 85, and the wax expands in response to the cooling water temperature, so that the thermostat 85 is opened. When the cooling water temperature is low and the wax contracts, the thermostat 85 is closed, and cooling water flows from the bypass pipe 44 into the thermostat case 74 through the through passage 83. When the cooling water temperature rises and the wax expands, the thermostat 85 is opened, and cooling water flows from the outlet pipe 46 into the thermostat case 74. The flow rate of cooling water from the bypass pipe 44 into the thermostat case 74 decreases by an amount of an increase in the flow rate of cooling water from the outlet pipe 46 into the thermostat case 74.

Figure 8:
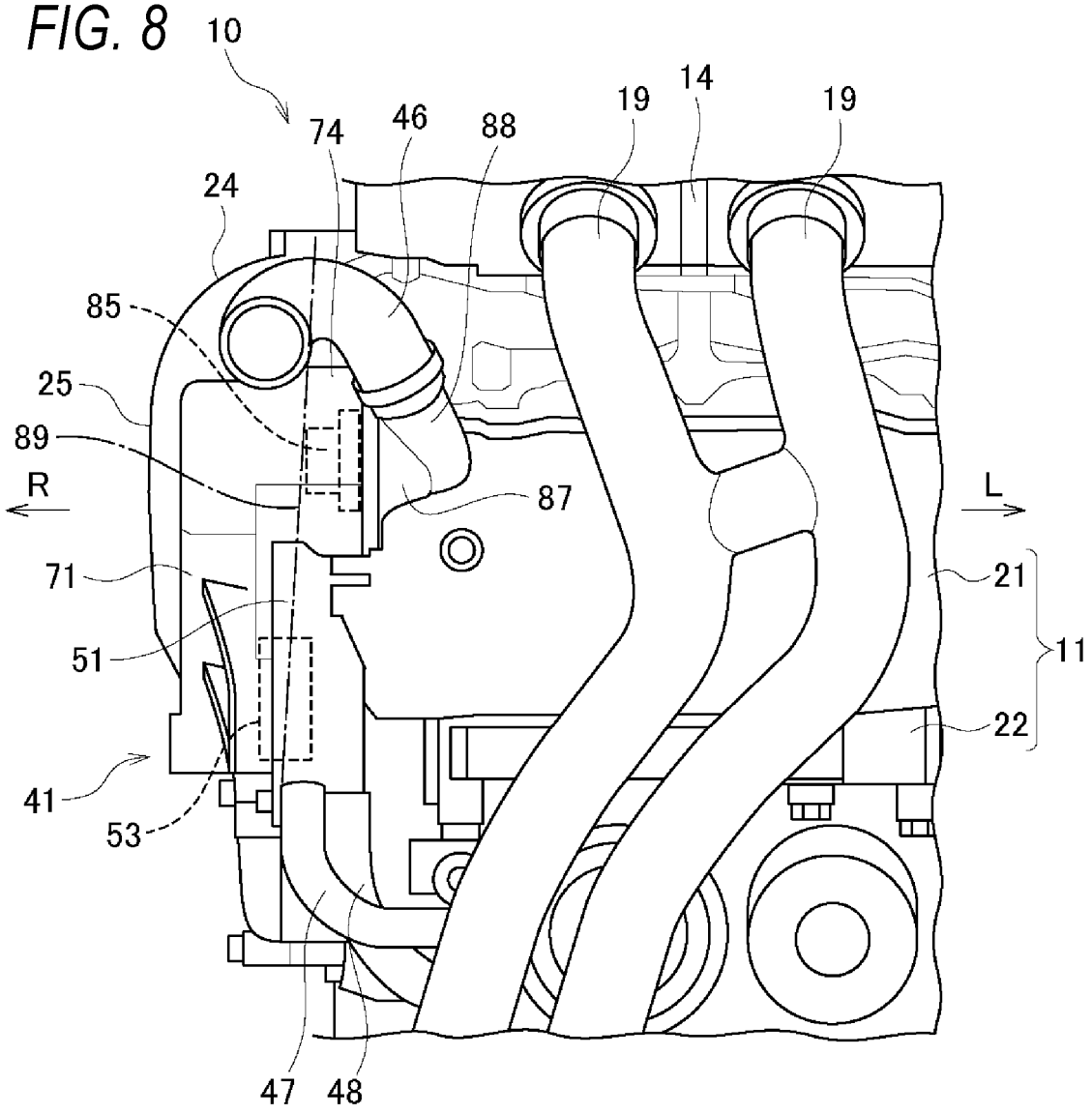
FIG. 8 is a front view of a part where a cooling apparatus is provided.
Figure 9:
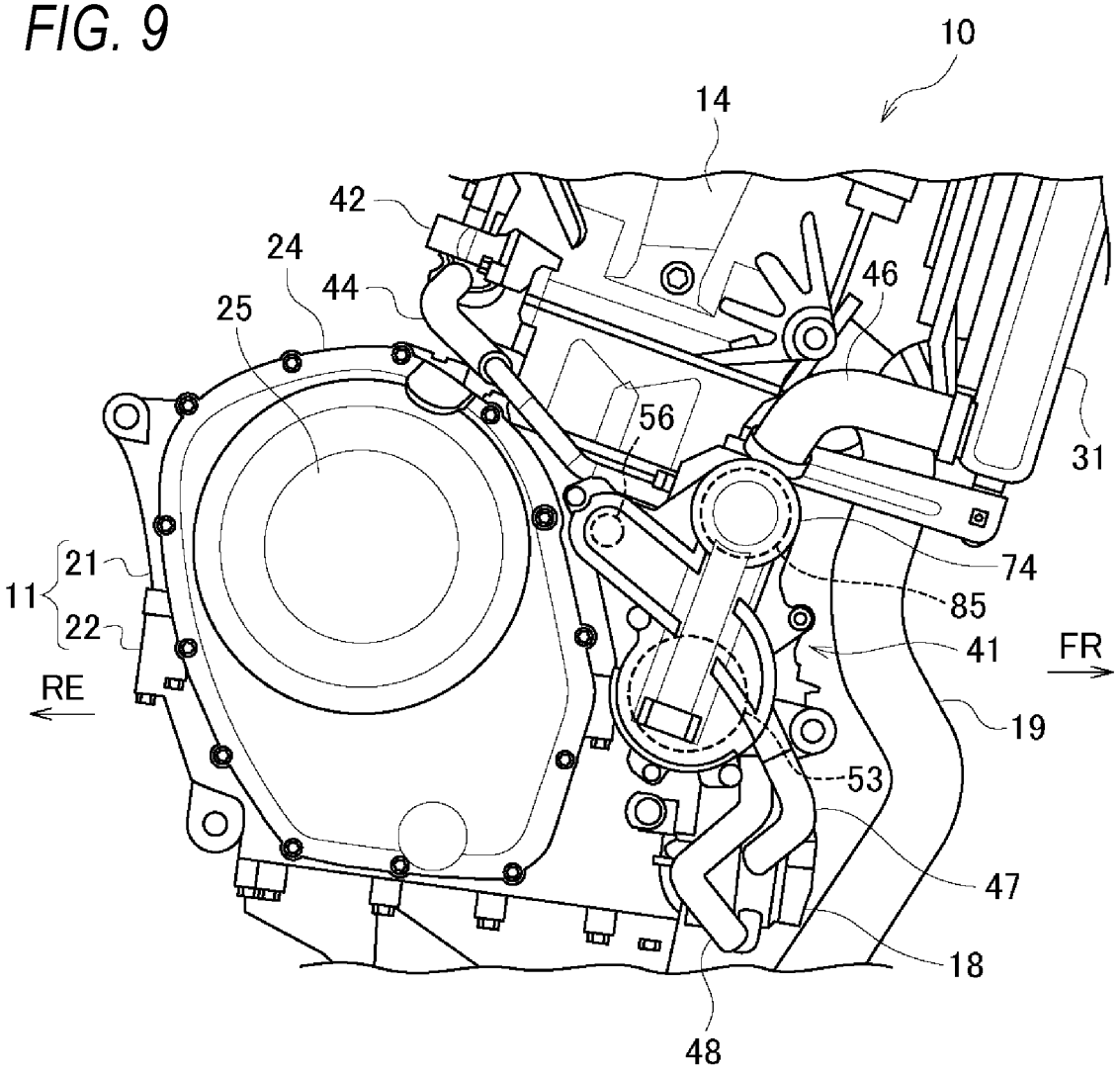
FIG. 9 is a right side view of the part where the cooling apparatus is provided.

An installation structure of the cooling apparatus will be described with reference to FIGS. 8 and 9. FIG. 8 is a front view of a part where the cooling apparatus is provided. FIG. 9 is a right side view of the part where the cooling apparatus is provided.

As shown in FIG. 8, the water pump 41 is attached to the crankcase 11 from the outside in the vehicle width direction, and the thermostat 85 is attached to the thermostat case 74 of the water pump 41 from the inside in the vehicle width direction. The thermostat case 74 extends inward in the vehicle width direction and overlaps the water pump case 51 in the upper-lower direction. In this case, the thermostat 85 in the thermostat case 74 is positioned inside the impeller 53 in the water pump case 51 in the vehicle width direction, and inside a mating surface 89 of the crankcase 11 and the clutch cover 24 in the vehicle width direction.

Therefore, the thermostat 85 is partially overlapped with the crankcase 11 in a front view of the engine 10. The water pump 41 is positioned inside the outer surface 25 of the clutch cover 24 in the vehicle width direction, so that an increase in a width dimension of the engine 10 in the vehicle width direction is prevented. Since the thermostat cover 87 is attached to the water pump 41 from the inside in the vehicle width direction, a pipe connected to the thermostat cover 87 is inconspicuous. The thermostat cover 87 and the outlet pipe 46 are shielded by the water pump cover 71 as viewed from a right side, so that the external appearance of the engine 10 is improved (see FIG. 9).

A pair of exhaust pipes 19 extend downward from the cylinder head 14, and one exhaust pipe 19 is positioned on a left side of the thermostat cover 87. At a height position of the thermostat cover 87, the exhaust pipe 19 is inclined upward to the outside (the right side) in the vehicle width direction. An inclination of the pipe 88 of the thermostat cover 87 is parallel to an inclination of the exhaust pipe 19, and a tip end of the pipe 88 is directed to the outside in the vehicle width direction. Even if the outlet pipe 46 is shifted inward in the vehicle width direction, a gap is secured between the outlet pipe 46 and the exhaust pipe 19 to prevent heat damage to the outlet pipe 46 due to the exhaust pipe 19. Assembling property of the outlet pipe 46 with respect to the pipe 88 is improved. The pipe 88 and the exhaust pipe 19 may be substantially parallel to each other.

As shown in FIG. 9, in the upper-lower direction of the engine 10, the thermostat 85 is positioned above the impeller 53 and between the radiator 31 and the impeller 53. In a front-rear direction of the engine 10, the thermostat 85 is on a front side of the water pump 41, and the thermostat 85 is partially overlapped with the cylinder block 13 in a side view of the engine 10. The ejection port 56 of the water pump 41 and the thermostat 85 are arranged in the front-rear direction of the engine 10 at substantially the same height. With this positional relation, the water pump 41 does not largely protrude forward from the crankcase 11, and the width dimension of the engine 10 in the front-rear direction is reduced.

The outlet pipe 46 extending from the radiator 31 is connected to the thermostat cover 87 (see FIG. 8) from above the engine 10. The bypass pipe 44 that bypasses the radiator 31 is connected to a rear part of the thermostat case 74 from behind the engine 10. The inlet pipe 47 and the outlet pipe 48 that extend from the oil cooler 18 are connected to a lower part of the water pump case 51 from below the engine 10. That is, a plurality of pipes 44, 46, 47, 48 are connected to the water pump 41 from three directions, that is, from above, behind, and below the engine 10.

The outlet pipe 46, the bypass pipe 44, the inlet pipe 47, and the outlet pipe 48 are positioned inward of an outer surface of the water pump cover 71 in the vehicle width direction (see FIG. 8). Therefore, the outlet pipe 46, the bypass pipe 44, the inlet pipe 47, and the outlet pipe 48 extend and do not overlap one another in the vehicle width direction, and do not protrude from the outer surface 25 of the clutch cover 24 to the outside in the vehicle width direction. Therefore, even in a configuration in which the plurality of pipes 44, 46, 47, 48 are connected to the water pump 41, the increase in the width dimension of the engine 10 in the vehicle width direction is prevented.

Further, the thermostat case 74 is at an upper part of the water pump 41, and is between the radiator 31 in front of the cylinder block 13 and the connector 42 at the rear part of the cylinder block 13. Therefore, the outlet pipe 46 from the radiator 31 toward the thermostat case 74 and the bypass pipe 44 from the connector 42 toward the thermostat case 74 can be formed short. Further, since the oil cooler 18 is below the water pump 41, the inlet pipe 47 and the outlet pipe 48 that extend from a lower part of the water pump 41 toward the oil cooler 18 can be formed short.

As described above, according to the present embodiment, even if the thermostat 85 is provided at the water pump 41, the thermostat 85 does not protrude largely from the crankcase 11 to the outside in the vehicle width direction. Therefore, the increase in the width dimension of the engine 10 in the vehicle width direction is prevented, and a size of the engine 10 is reduced. Since the thermostat 85 is attached to the inside of the water pump 41 in the vehicle width direction, the pipe connected to the thermostat 85 is inconspicuous, and the external appearance of the engine 10 is improved. Further, the pipe for the water pump 41 is not complicated, and the assembling property of the pipe is improved.

In the present embodiment, the thermostat is positioned inside the impeller in the vehicle width direction. However, the present invention is not limited to this configuration. If the thermostat is attached to the water pump from the inside in the vehicle width direction, the thermostat may be positioned slightly outside the impeller in the vehicle width direction.

In the present embodiment, a part of the water pump cover protrudes above the water pump case to form the thermostat case. However, the present invention is not limited to this configuration. In the thermostat case, the part of the water pump cover may protrude with respect to the water pump case in a direction perpendicular to the vehicle width direction to form the thermostat case. For example, the part of the water pump cover may protrude forward from the water pump case to form the thermostat case.

In the present embodiment, the pipe of the thermostat cover is formed parallel to the exhaust pipe. However, the present invention is not limited to this configuration. The pipe may be formed non-parallel to the exhaust pipe so as not to be damaged by heat from the exhaust pipe.

The engine cooling apparatus according to the present embodiment may be appropriately applied to other vehicles in which engines are provided, for example, a personal watercraft, a lawn mower, an outboard motor, and the like, in addition to an automatic four-wheel vehicle and a buggy-type motor tricycle.

As described above, a cooling apparatus (40) of an engine (10) according to the present embodiment is an engine cooling apparatus configured to circulate cooling water between an engine in which a cylinder (the cylinder block 13) is provided and a radiator (31). The radiator (31) is configured to radiate heat of cooling water that has passed through the engine. The cooling apparatus (40) includes a water pump (41) configured to eject cooling water toward the engine and a thermostat (85) configured to send cooling water to the radiator in response to a cooling water temperature. The water pump is attached to the crankcase from an outside in a vehicle width direction. The thermostat is attached to the water pump from an inside in the vehicle width direction. The thermostat overlaps the crankcase in a front view of the engine. According to this configuration, even if the thermostat is provided at the water pump, the thermostat does not protrude largely from the crankcase to the outside in the vehicle width direction. Therefore, the increase in the width dimension of the engine in the vehicle width direction is prevented, and a size of the engine is reduced. Since the thermostat is attached to the inside of the water pump in the vehicle width direction, the pipe connected to the thermostat is inconspicuous, and the external appearance of the engine is improved. Further, the pipe for the water pump is not complicated, and the assembling property of the pipe is improved.

In the engine cooling apparatus according to the present embodiment, the water pump includes an impeller (53) configured to pump cooling water, and the thermostat is positioned inside the impeller in the vehicle width direction. According to this configuration, it is possible to further reduce the dimension width of the engine in the vehicle width direction.

In the engine cooling apparatus according to the present embodiment, the radiator is positioned in front of the cylinder, and the thermostat is positioned above the impeller and between the radiator and the impeller. According to this configuration, the thermostat is positioned between the radiator and the impeller in the upper-lower direction of the engine, so that the width dimension of the engine in the front-rear direction can be reduced, and the pipe connecting the radiator and the thermostat can be shortened.

In the engine cooling apparatus according to the present embodiment, the water pump includes a water pump case (51) in which one surface is opened, and a water pump cover (71) that covers an opening of the water pump case, the water pump case is attached to the crankcase, and a part of the water pump cover protrudes in a direction perpendicular to the vehicle width direction with respect to the water pump case to form the thermostat case (74) that houses the thermostat. According to this configuration, the thermostat case is formed by a part of the water pump cover protruding in a direction perpendicular to the vehicle width direction from the water pump case. Therefore, the thermostat can be housed in the water pump cover without causing the water pump cover to bulge outward in the vehicle width direction. The water pump is formed compactly, and the housing chamber of the thermostat is inconspicuous, and the external appearance of the engine is improved.

In the engine cooling apparatus according to the present embodiment, a thermostat cover (87) that covers the housing chamber of the thermostat is attached to the thermostat case, a pipe (88) for pipe joint is formed at the thermostat cover, an inclination of the pipe is parallel to an inclination of the exhaust pipe (19) extending downward from the cylinder, and a tip end of the pipe is directed to the outside in the vehicle width direction. According to this configuration, even if the pipe for the thermostat is shifted inward in the vehicle width direction, a gap is secured between the pipe and the exhaust pipe to prevent heat damage to the pipe due to the exhaust pipe. Since the tip end of the pipe is directed to the outside in the vehicle width direction, the assembling property of the pipe with respect to the thermostat cover is improved.

In the engine cooling apparatus according to the present embodiment, a radiator pipe (the outlet pipe 46) extending from the radiator is connected to the water pump from above the engine, oil cooler pipes (the inlet pipe 47 and the outlet pipe 46) extending from an oil cooler (18) is connected to the water pump from below the engine, and a bypass pipe (44) that bypasses the radiator is connected to the water pump from behind the engine. According to this configuration, since the pipes are connected to the water pump from three sides, the plurality of pipes are less likely to overlap in the vehicle width direction, and the width dimension of the engine in the vehicle width direction can be reduced.

In view of the above, according to the engine cooling apparatus in an aspect of the invention, even if the thermostat is provided at the water pump, the thermostat does not protrude largely from the crankcase to the outside in the vehicle width direction. Therefore, the increase in the width dimension of the engine in the vehicle width direction is prevented, and a size of the engine is reduced. Since the thermostat is attached to the inside of the water pump in the vehicle width direction, the pipe connected to the thermostat is inconspicuous, and the external appearance of the engine is improved. Further, the pipe for the water pump is not complicated, and the assembling property of the pipe is improved.

Although the present embodiment has been described, the above-described embodiment and the modification may be combined in whole or in part as another embodiment.

The technique of the present invention is not limited to the above-described embodiment, and various changes, substitutions, and modifications may be made without departing from the spirit of the technical idea of the present invention. Further, the present invention may be implemented using other methods as long as the technical concepts of the present invention can be implemented by the methods through advance of the technology or other derivative technology. Accordingly, the claims cover all embodiments that may be included within the scope of the technical concepts.

What is claimed is:

1. An engine cooling apparatus configured to circulate cooling water between an engine and a radiator, wherein a cylinder is provided on an upper part of a crankcase in the engine and the radiator is configured to radiate heat of the cooling water that has passed through the engine, the engine cooling apparatus comprising:

a water pump configured to eject cooling water toward the engine; and a thermostat configured to send cooling water to the radiator in response to a cooling water temperature, wherein the water pump is attached to the crankcase from an outside in a vehicle width direction, the thermostat is attached to the water pump from an inside in the vehicle width direction, the thermostat overlaps the crankcase in a front view of the engine, the water pump includes an impeller configured to pump cooling water, the thermostat is positioned inside the impeller in the vehicle width direction, the radiator is positioned in front of the cylinder, and the thermostat is positioned above the impeller and between the radiator and the impeller.

2. The engine cooling apparatus according to claim 1, wherein the water pump includes a water pump case in which one surface thereof is opened and a water pump cover that covers an opening of the water pump case, and the water pump case is attached to the crankcase, and a part of the water pump cover protrudes in a direction perpendicular to the vehicle width direction with respect to the water pump case, to form a thermostat case that houses the thermostat.

3. The engine cooling apparatus according to claim 2, further comprising:

a thermostat cover that covers a housing chamber of the thermostat and is attached to the thermostat case, and a pipe for pipe joint is-formed at the thermostat cover, wherein an inclination of the pipe is parallel to an inclination of an exhaust pipe extending downward from the cylinder, and a tip end of the pipe is directed to an outside in the vehicle width direction.

4. The engine cooling apparatus according to claim 1, further comprising:

a radiator pipe extending from the radiator and connected to the water pump from above the engine, an oil cooler pipe extending from an oil cooler and connected to the water pump from below the engine, and a bypass pipe that bypasses the radiator and connected to the water pump from behind the engine.

5. The engine cooling apparatus according to claim 1, wherein the water pump includes a water pump case, the water pump case is provided with an ejection port through which the cooling water is fed into the crank case, and the ejection port and the thermostat are arranged in the front-rear direction of the engine at substantially the same height.

6. The engine cooling apparatus according to claim 5, further comprising:

a thermostat cover that covers a housing chamber of the thermostat and is attached to the water pump from the inside in the vehicle width direction, and an outlet pipe that returns from the radiator to the water pup is connected to the thermostat cover, wherein the ejection port is disposed at a rear side of the thermostat cover in a side view of the engine.

* * * * *